US009305477B2

(12) United States Patent
Senda et al.

(10) Patent No.: US 9,305,477 B2
(45) Date of Patent: Apr. 5, 2016

(54) ORGANIC LIGHT EMITTING DISPLAY DEVICE

(75) Inventors: Takahiro Senda, Yongin (KR); Keum-Nam Kim, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 537 days.

(21) Appl. No.: 13/137,960

(22) Filed: Sep. 22, 2011

(65) Prior Publication Data

US 2012/0139820 A1 Jun. 7, 2012

(30) Foreign Application Priority Data

Dec. 2, 2010 (KR) ..... 10-2010-0121968

(51) Int. Cl.
*G09G 3/30* (2006.01)
*G09G 3/00* (2006.01)
*G09G 3/32* (2006.01)

(52) U.S. Cl.
CPC ..... *G09G 3/003* (2013.01); *G09G 3/3233* (2013.01); *G09G 3/3266* (2013.01); *G09G 2300/0842* (2013.01); *G09G 2300/0861* (2013.01); *G09G 2310/0218* (2013.01)

(58) Field of Classification Search
CPC ..... G09G 3/30
See application file for complete search history.

(56) References Cited

U.S. PATENT DOCUMENTS

2007/0046608 A1* 3/2007 Chung ..... 345/92
2007/0229413 A1 10/2007 Hara
2011/0032342 A1 2/2011 Kato et al.
2011/0285752 A1* 11/2011 Park et al. ..... 345/690
2012/0026207 A1 2/2012 Komiya et al.
2012/0044240 A1 2/2012 Chung et al.
2012/0105605 A1 5/2012 Nam et al.

FOREIGN PATENT DOCUMENTS

JP 2006-301250 A 11/2006
JP 2007-293264 A 11/2007
JP 2012-93697 A 5/2012
KR 10-2012-0010826 A 2/2012
KR 10-2012-0017586 A 2/2012
WO WO 2010/082479 A1 7/2010

OTHER PUBLICATIONS

Japanese Office Action dated Jan. 27, 2015.
Japanese Notice of Allowance dated Sep. 29, 2015.

* cited by examiner

*Primary Examiner* — Claire X Pappas
*Assistant Examiner* — Sepideh Ghafari
(74) *Attorney, Agent, or Firm* — Lee & Morse, P.C.

(57) ABSTRACT

An organic light emitting display device of the present embodiments includes: a plurality of pixels positioned at intersections of scan lines, data lines, and emission control lines; a pixel unit, including the plurality of pixels, and divided into two or more blocks; a scan driver sequentially supplying scan signals to the scan lines; a data driver supplying data signals to the data lines in synchronization with the scan signals; and two or more emission drivers connected with emission control lines in the blocks, in which each emission driver supplies emission control signals to emission control lines connected thereto, and at least one or more emission control signals are supplied in each block simultaneously.

19 Claims, 8 Drawing Sheets

ORGANIC LIGHT EMITTING DISPLAY DEVICE

BACKGROUND

1. Field

The present embodiments relate to an organic light emitting display device and a driving method thereof. More particularly, the present embodiments relate to an organic light emitting display device that can operate at a low driving frequency.

2. Description of the Related Art

Recently, a variety of flat panel displays have been developed that make it possible to reduce the weight and volume of cathode ray tubes. Typical flat panel displays may be a liquid crystal display, a field emission display, a plasma display panel, an organic light emitting display device, etc.

In the flat panel display devices, the organic light emitting display device displays an image using organic light emitting diodes. The light emitting diodes emit light by recombining electrons and holes. The organic light emitting display device has a high response speed and low power consumption.

The organic light emitting display device includes a plurality of data lines, scan lines, and a plurality of pixels. The plurality of pixels is arranged in a matrix, at intersections of power lines. The pixels are usually composed of two or more transistors. The pixels also include an organic light emitting diode, a driving transistor, and one or more capacitors.

SUMMARY

The present embodiments may provide an organic light emitting display device and a driving method of the organic light emitting display device.

An organic light emitting display device, according to an embodiment, may include: a plurality of pixels positioned at intersections of scan lines, data lines, and emission control lines; a pixel unit, including the plurality of pixels, and divided into two or more blocks; a scan driver sequentially supplying scan signals to the scan lines; a data driver supplying data signals to the data lines in synchronization with the scan signals; and two or more emission drivers connected with emission control lines in the blocks, in which each emission drivers supplies emission control signals to emission control lines connected thereto, and at least one or more emission control signals are supplied in each block simultaneously.

An emission driver, connected with emission control lines, in a last block of the blocks, may sequentially supply emission control signals from a first emission control line to a last emission control line, after a scan signal is supplied to a first scan line in the last block. Emission drivers may be connected with emission control lines, respectively, in blocks other than the last block, sequentially supply emission control signals from a first emission control line to a last emission control line, connected thereto. Each emission driver may supply emission control signals to the first emission control lines simultaneously supplied.

An emission driver, connected with emission control lines in a first block of the blocks, may supply emission control signals to the first emission control line, until a scan signal is supplied to a first scan line in the first block. Widths of all of the emission control signals supplied to the emission control lines may be set to be the same. The pixel unit may be divided into three blocks, and the last block is a third block. An emission driver, connected with emission control lines in a first block of the three blocks, may sequentially supply emission control signals from a first emission control line to a last emission control line, connected thereto.

Emission control signals may be simultaneously supplied to the first emission control lines in the first block and the third block. An emission driver, connected with emission control lines in a second block of the three blocks, may sequentially supply emission control signals from a last emission control line to a first emission control line, connected thereto. The emission driver, connected with the emission control lines in the second block, may supply an emission control signal to the last emission control line connected thereto, after a scan signal is supplied to a last scan line in the second block. A number of emission control lines in the second block, before the first and third blocks, may be set larger than a number of emission control lines in the first block and the third block. The emission driver, connected with the emission control lines in the second block, may simultaneously supply emission control signals to the emission control lines connected thereto.

Emission control signals may be supplied to the emission control lines in the second block, simultaneously with an emission control signal being supplied to the first emission control line in the third block. The emission driver, connected with the emission control lines in the first block, may sequentially supply emission control signals from the first emission control line to the last emission control line which are connected thereto. An emission control signal may be supplied to the last emission control line in the first block, simultaneously with a supply of an emission control signal to an emission control line in the second block.

Each pixel of the plurality of pixels may include: an organic light emitting diode; a pixel circuit charged with a voltage corresponding to a data signal when a scan signal is supplied to a scan line; the pixel circuit controlling the amount of current supplied to the organic light emitting diode, corresponding to the voltage; and a control transistor, connected between the organic light emitting diode and the pixel circuit, the control transistor turned on when an emission control signal is supplied to an emission control line, the control transistor turned off in other cases.

BRIEF DESCRIPTION OF THE DRAWINGS

The accompanying drawings, together with the specification, illustrate exemplary embodiments, and, together with the description, serve to explain the principles of the inventive concept.

DETAILED DESCRIPTION

Korean Patent Application No. 10-2010-0121968, filed on Dec. 2, 2010, in the Korean Intellectual Property Office, and entitled: "Organic Light Emitting Display Device and Driving Method Thereof" is incorporated by reference herein in its entirety.

The inventive concept will now be described more fully hereinafter with reference to the accompanying drawings, in which exemplary embodiments of the inventive concept are illustrated. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art.

Preferred embodiments for those skilled in the art to easily implement are described hereafter in detail with reference to FIGS. 1 to 7.

Figure 1:
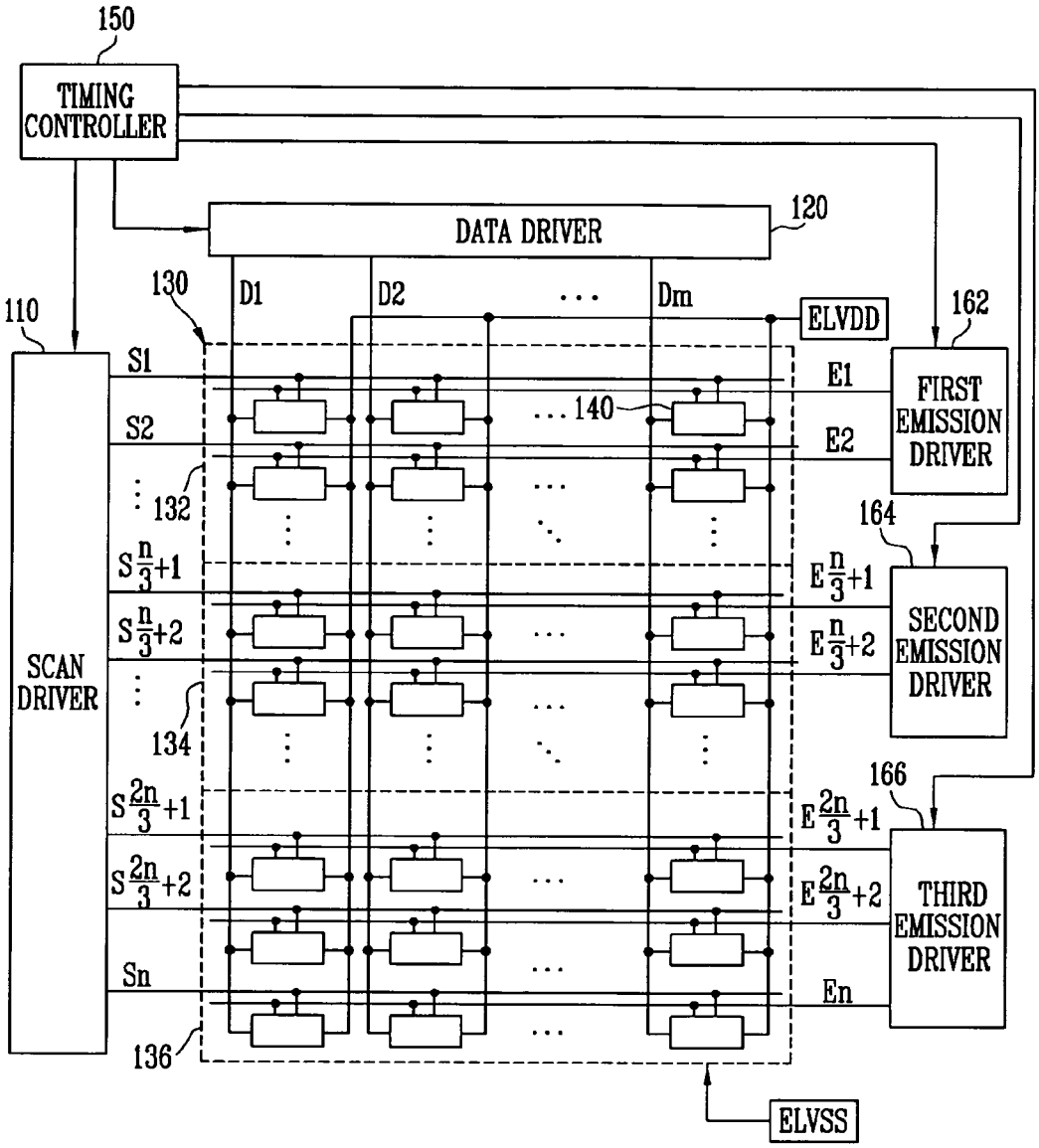
FIG. 1 is a diagram illustrating an organic light emitting display device according to an embodiment.

FIG. 1 is a diagram illustrating an organic light emitting display device according to an embodiment.

Referring to FIG. 1, an organic light emitting display device, according to an embodiment, includes a pixel unit 130 divided into a plurality of blocks 132, 134, and 136, pixels 140 arranged in a matrix in the pixel unit 130, a scan driver 110 driving scan lines S1 to Sn connected with the pixels 140, emission drivers 162, 164, and 166 driving emission control lines E1 to En connected with the pixels 140, a data driver 120 driving data lines D1 to Dm connected with the pixels 140, and a timing controller 150 controlling the drivers 110, 120, 162, 164, and 166.

The pixels 140 are formed at the intersections of the data lines S1 to Sn, the data lines D1 to Dm, and the emission control lines E1 to En. The pixels are selected when a scan signal is supplied to the scan lines (any one of S1 to Sn) and receives a data signal through the data lines (any one of D1 to Dm). When an emission control signal is supplied to the emission control lines (any one of E1 to En), the pixels 140 emit light at luminance corresponding to the data signal.

The pixel unit 130 includes the pixels 140 arranged in a matrix. The pixel unit 130 is divided into a plurality of blocks 132, 134, and 136. Each of the blocks 132, 134, and 136 includes two or more scan lines. Although it is shown in FIG. 1 that the pixel unit 130 is divided into three blocks 132, 134, and 136, the present embodiments are not limited thereto. The pixel unit 130 may be divided into two or more blocks.

The scan driver 110 sequentially supplies scan signals to the scan lines S1 to Sn, for each frame period.

The data driver 120 supplies data signals to the data lines D1 to Dm to be synchronized with the scan signals supplied to the scan lines S1 to Sn. The data driver 120 supplies left data signals in response to the scan signals supplied to the scan lines S1 to Sn during an i-th (i is a natural number) frame iF period, and supplies right data signals in response to the scan signals supplied to the scan lines S1 to Sn during an i+1-th frame i+1F period.

The first emission driver 162 supplies emission control signals to the emission control lines E1, E2, . . . in the first block 132.

The second emission driver 164 supplies emission control signals to the emission control lines En/3+1, En/3+2, . . . in the second block 134.

The third emission driver 166 supplies emission control signals to the emission control lines E2*n*/3+1, E2*n*/3+2, . . . in the third block 136.

The pixels 140 in the blocks 132, 134, and 136 emit light when an emission control signal is supplied to the emission control line (any one of E1 to En). The pixels 140 in the blocks 132, 134, and 136 are turned off when an emission control signal is not supplied. The emission control signal is set at the voltage having the same polarity (e.g. low voltage) as the scan signal.

The emission drivers 162, 164, and 166 are provided for the blocks 132, 134, and 136, respectively. Therefore, if the pixel unit 130 is divided into four blocks, four emission drivers are provided for the blocks, respectively. The detailed operations of the emission drivers 162, 164, and 166 are described below.

The emission controller 150 controls the drivers 110, 120, 150, 162, 164, and 166.

Figure 2:
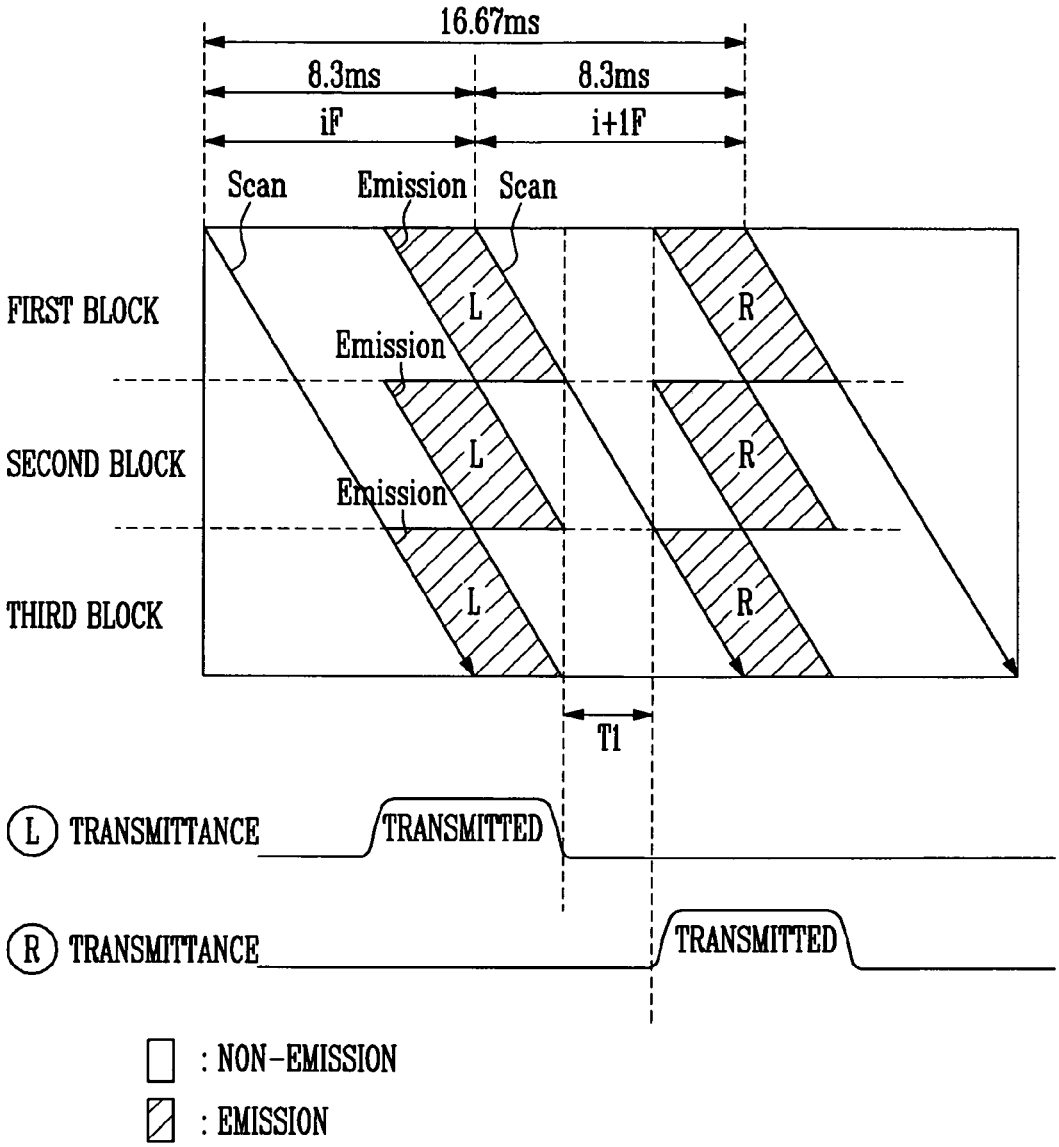
FIG. 2 is a diagram showing frame periods of an organic light emitting display device according to a first embodiment.

FIG. 2 is a diagram showing frame periods according to a first embodiment.

Referring to FIG. 2, in the first embodiment, the scan driver 110 sequentially supplies scan signals to the scan lines S1 to Sn for each of the frame periods iF and i+1F. Since one frame period is set to 8.3 ms, the scan driver 110 supplies scan signals at a driving frequency of 120 Hz. The data driver 120, that supplies data signals in synchronization with the scan signals, also supplies data signals to the data lines D1 to Dm at a driving frequency of 120 Hz.

The emission drivers 162, 164, and 166 sequentially supply emission control signals from the first emission control lines E1, En/3+1, and E2*n*/3+1 to the last emission control lines En/3, E2*n*/3, and En. The last emission control lines En/3 E2*n*/3, and En are connected with themselves. In this configuration, the emission drivers 162, 164, and 166 supply emission control signals to the first emission control lines E1, En/3+1, and E2*n*/3+1. The first emission control lines E1, En3+1, and E2*n*/3+1 are connected at the same time with themselves. Therefore, the emission control signals are sequentially supplied at the same time to the first emission control lines E1, En/3+1, and E2*n*/3+1 to the last emission control lines En/3, E2*n*/3, and En. The last emission control lines En/3, E2*n*/3, and En are connected with the emission drivers 162, 164, and 166.

Figure 3:
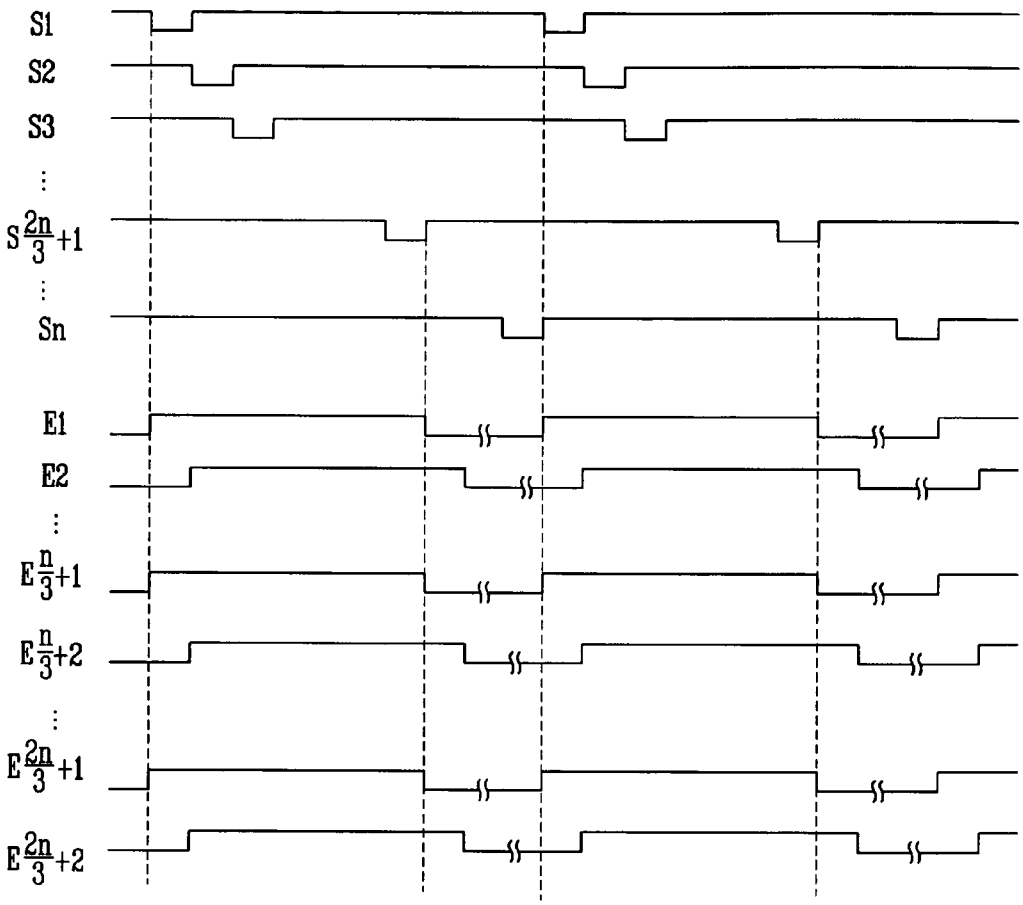
FIG. 3 is a waveform diagram showing driving waveforms supplied to scan lines and emission control lines during the frame periods of FIG. 2.

As shown in FIG. 3, after scan signals are supplied to the first scan lines S2*n*/3+1 of the third block (or the last block), the emission drivers 162, 164, and 166, sequentially supply emission control signals from the first emission control lines E1, En/3+1, E2*n*/3+1. Until scan signals are supplied to the first scan line S1 in the first block, the emission drivers 162, 164, and 166 supply the emission control signals to the first emission control lines E1, En/3+1, E2*n*/3+1.

The emission control signals supplied to all the emission control lines E1 to En have the same widths. Thus, the pixels 140 emit light for a predetermined period in the blocks. As in the present embodiment, when the emission control signals are supplied to the emission control lines E1 to En, all of the pixels 140 are set in a non-emission state for the first period T1. The first period T1 is between the frames iF and i+1F.

The shutter glasses receive light through the left lens for the i frame iF period and through the right lens for the i+1 frame i+1F. In this process, a user recognizes the 3D image supplied through the shutter glasses. The response time of the shutter glasses (the point of time selected for the right lens or the left lens) is synchronized with the first period T1. The first period T1 is the time when the pixels 140 are set in the non-emission state. Thus, it is possible to display a 3D image without cross talk.

Figure 4:
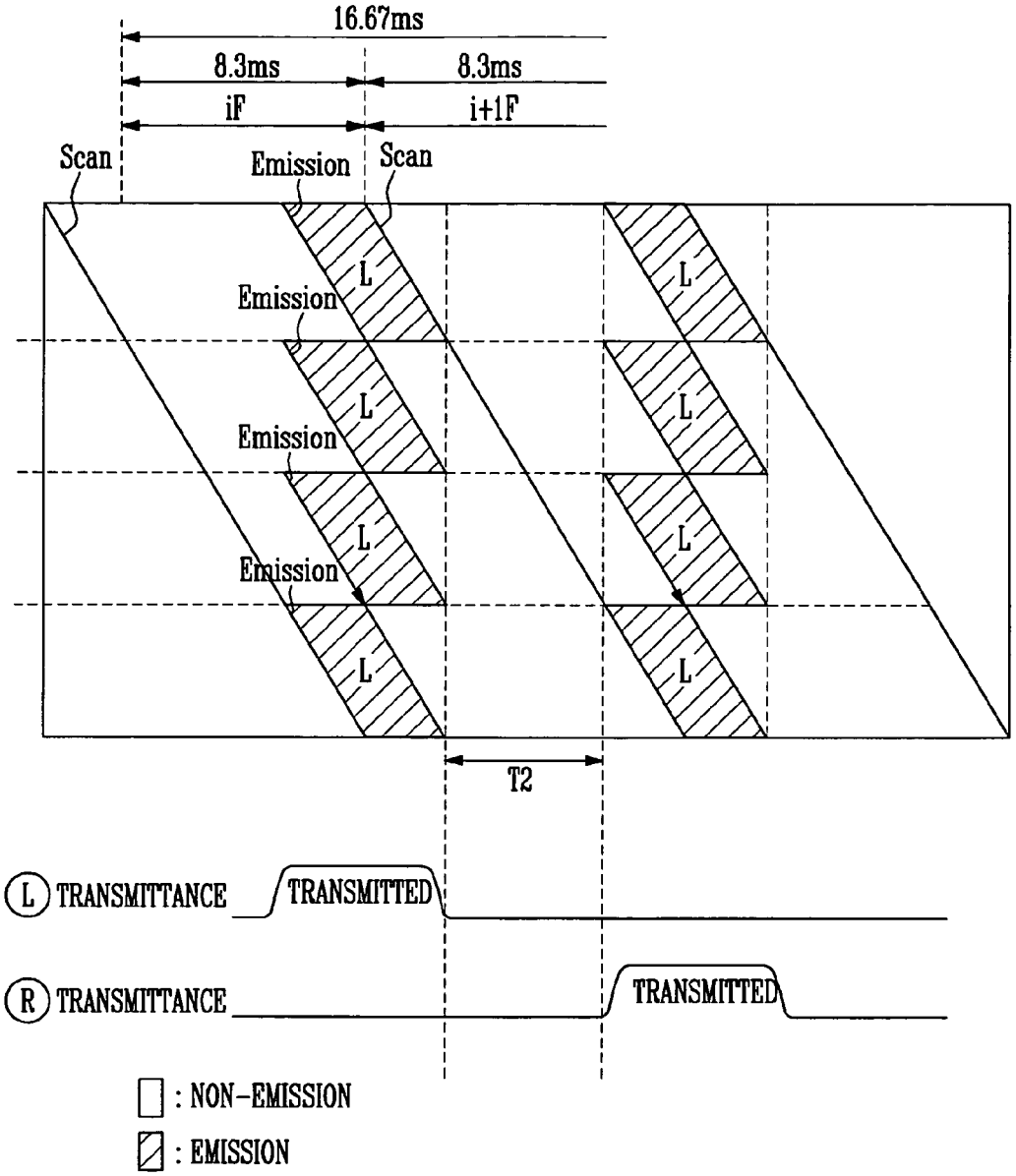
FIG. 4 is a diagram showing frame periods of an organic light emitting display device according to a second embodiment.

FIG. 4 is a diagram showing frame periods according to a second embodiment. The pixel unit shown in FIG. 4 operates in the same way as that shown in FIG. 2, but is divided into four blocks.

When the pixel unit is divided into four blocks, a non-emission period between the frames iF and i+1F, is set as a second period T2. In the case shown in FIG. 2, where the pixel unit is divided into three blocks, the first period T1 is set to be about ⅓ frame ⅓F. The second period T2 of FIG. 4, where the pixel unit is divided into four blocks, is set to ¼ frame ¼F.

Figure 5:
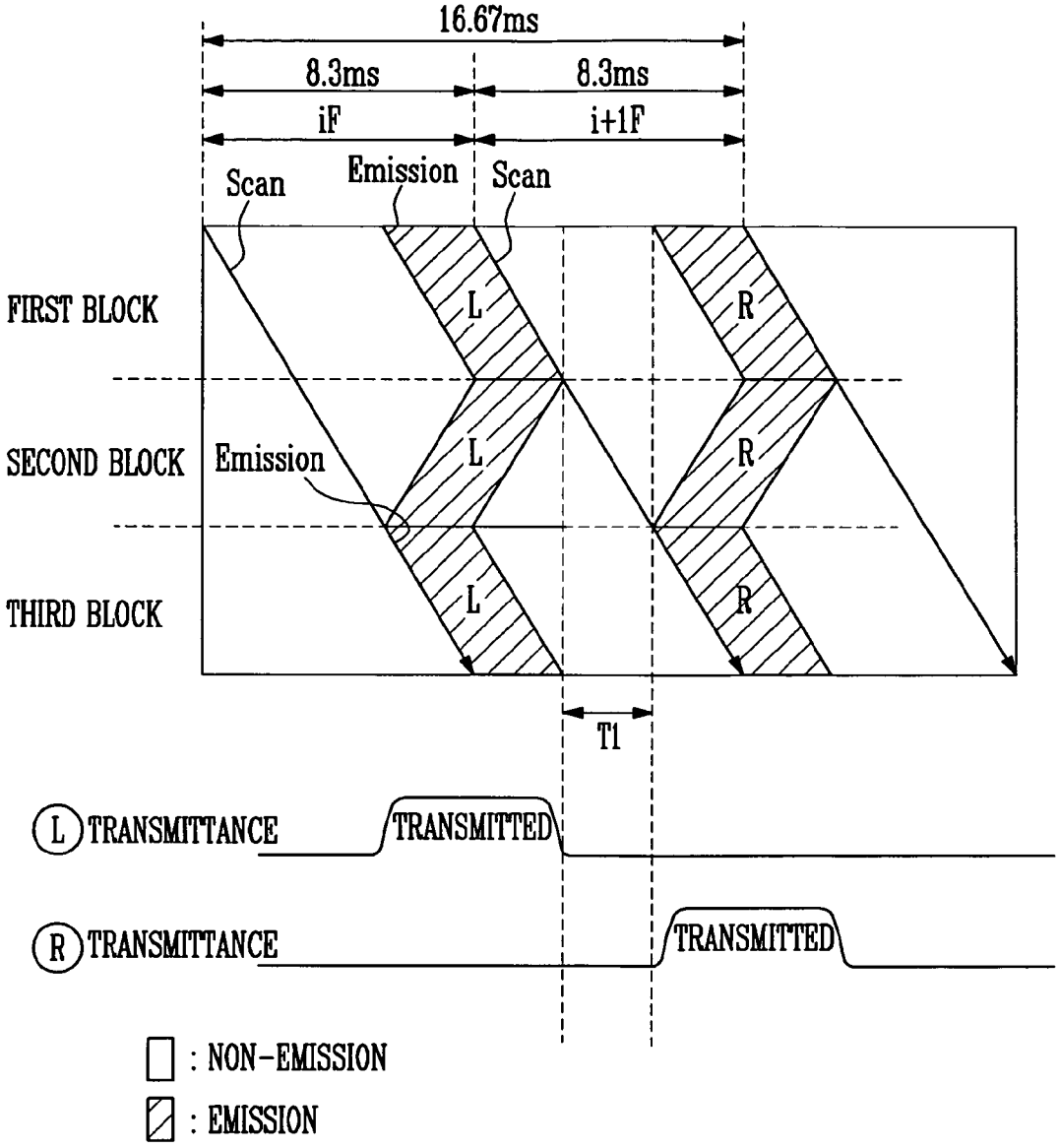
FIG. 5 is a diagram showing frame periods of an organic light emitting display device according to a third embodiment.

FIG. 5 is a diagram showing frame periods, according to a third embodiment.

Referring to FIG. 5, the scan driver 110 sequentially supplies scan signals to the scan lines S1 to Sn for each of the frame periods iF and i+1F. The data driver 120 supplies data signals to the data lines D1 to Dm, in synchronization with the scan signals.

The emission drivers 162, 164, and 166 sequentially supply emission control signals to the emission control lines, connected with themselves. In this configuration, the first emission driver 162 and the third emission driver 166 sequentially supply emission control signals from the first emission control lines E1 and E2*n*/3+1 to the last emission control lines En/3 and En. The last emission control lines En/3 and En are connected with themselves. The second emission driver 164 sequentially supplies emission control signals from the last emission control line E2*n*/3 to the first emission control line En/3+1. The first emission control line En/3+1 is connected with itself.

After scan lines are supplied to the first scan lines S2*n*/3+1 of the third block, the first emission driver 162 and the third emission driver 166 supply emission control signals from the first emission control lines E1 and E2*n*/3+1. The second emission driver 164 sequentially supplies emission control signals from the last emission control line E2*n*/3, connected with itself, in synchronization with the emission control signals supplied to the first emission control lines E1 and E2*n*/3+1. After a scan signal is supplied to the last scan line S2*n*/3 in the second block, the second emission driver 164 supplies an emission control signal to the last emission control line E2*n*/3 connected with itself.

In the third embodiment, the second emission driver 164 supplies emission control signals in the opposite order to the first and third emission drivers 162 and 166. Accordingly, it is possible to prevent a luminance difference at the interfaces of the blocks 132, 134, and 136.

When the scan signals are supplied, the pixels 140 are selected and charged with a voltage corresponding to the data signals. Due to leakage current, the voltage of the charged pixels 140 changes with time. As shown in FIG. 2, when the date-recording time and the emission time become different in the pixels at the interfaces, a luminance difference may be generated at the interfaces.

In the third embodiment, in the second block 134, emission control signals are sequentially supplied from the last emission control line E2*n*/3 to the first emission control line En/3+1. Therefore, the pixels at the interfaces of the blocks 132, 134, and 136 have substantially similar data-recording time and emission time (a time difference of 1 H). Thus, it is possible to prevent a luminance difference at the interfaces. The width of emission control signals and the supply time are set to be the same as those in FIG. 2. Thus, the detailed description is not provided.

Figure 6:
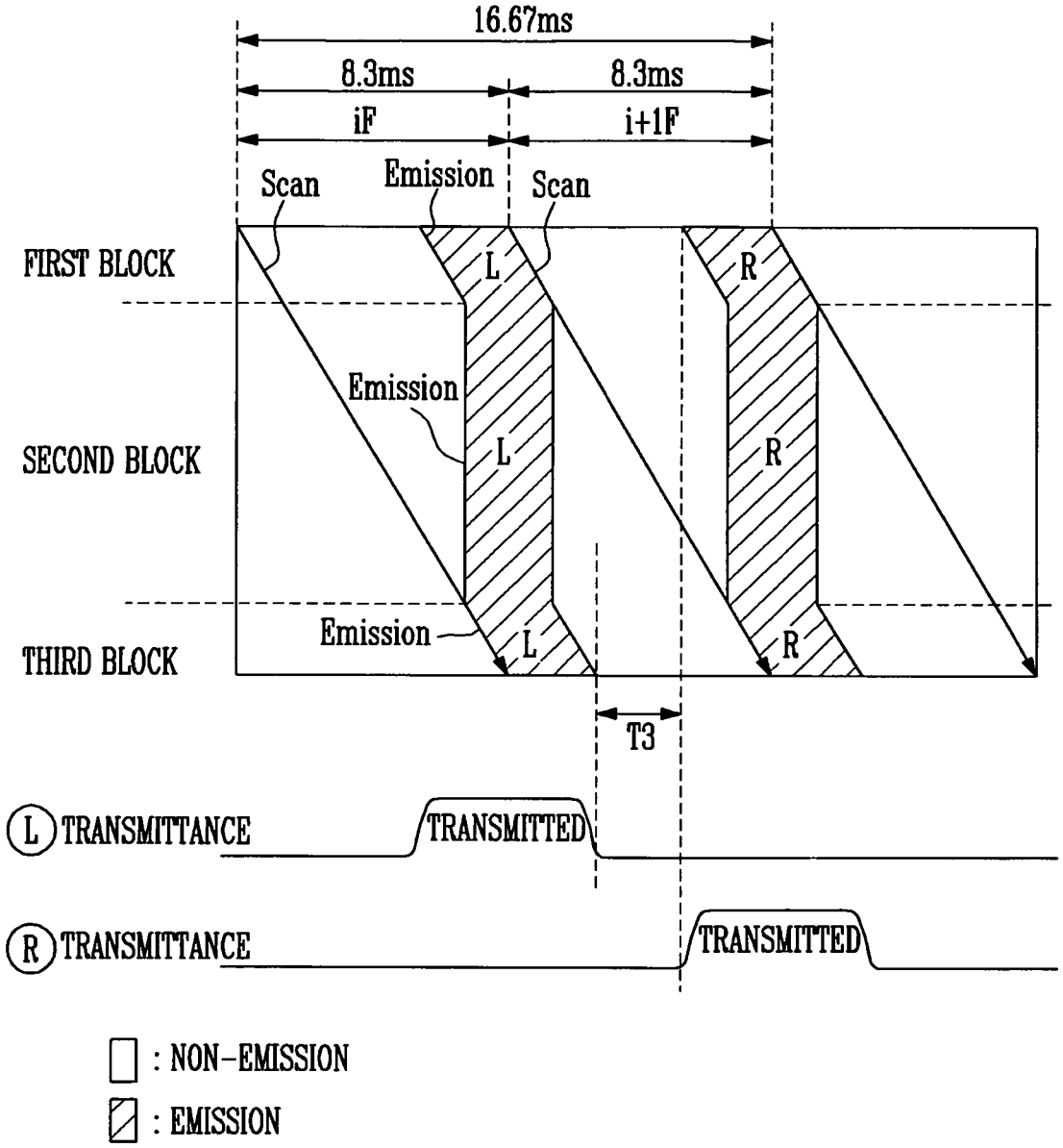
FIG. 6 is a diagram showing frame periods of an organic light emitting display device according to a fourth embodiment.

FIG. 6 is a diagram showing frame periods according to a fourth embodiment.

Referring to FIG. 6, the scan driver 110 sequentially supplies scan signals to the scan lines S1 to Sn for each of the frame periods iF and i+1F. The data driver 120 supplies data signals to the data lines D1 to Dm, in synchronization with the scan signals.

In the fourth embodiment, the number of emission control lines in the second block is set to be larger than the number of emission control lines in the first block and the third block.

The emission drivers 162, 164, and 166 sequentially supply emission control signals to the emission control lines, connected with themselves. In the process, the first emission driver 162 and the third emission driver 166 sequentially supply the emission control signals. The second emission driver 164 simultaneously supplies the emission control signals to all of the emission control lines in the second block.

After a scan signal is supplied to the first scan line in the third block, the third emission driver 166 supplies an emission control signal to the first emission control line in the third block. While sequentially supplying emission control signals to the second and the last emission control lines in the third block, the third emission driver 166 sets the pixels 140 in an emission state.

The second emission driver 164 simultaneously supplies emission control signals to the emission control lines, in the second block, in synchronization with the emission control signals supplied to the first emission control line of the third block.

In the first block, the first emission driver 162 sequentially supplies emission control signals to the emission control lines. In this process, the first emission driver 162 supplies the emission control signals to the last emission control line, in the first block, in synchronization with the emission control signals supplied to the emission control lines in the second block. In this process, the emission control signal supplied to the last emission control line in the first block is supplied until a scan signal is supplied to the scan line in the same horizontal line.

Regardless of the positions, the widths of the emission control signals, supplied to the emission control lines, are set to be the same width. As shown in FIG. 6, the emission time of the pixels is set at a portion of the frame periods. For the third period T3 in the frame periods, the pixels are set in a non-emission state. The larger the number of emission control lines in the second block, the larger the third period T3 is set.

Figure 7:
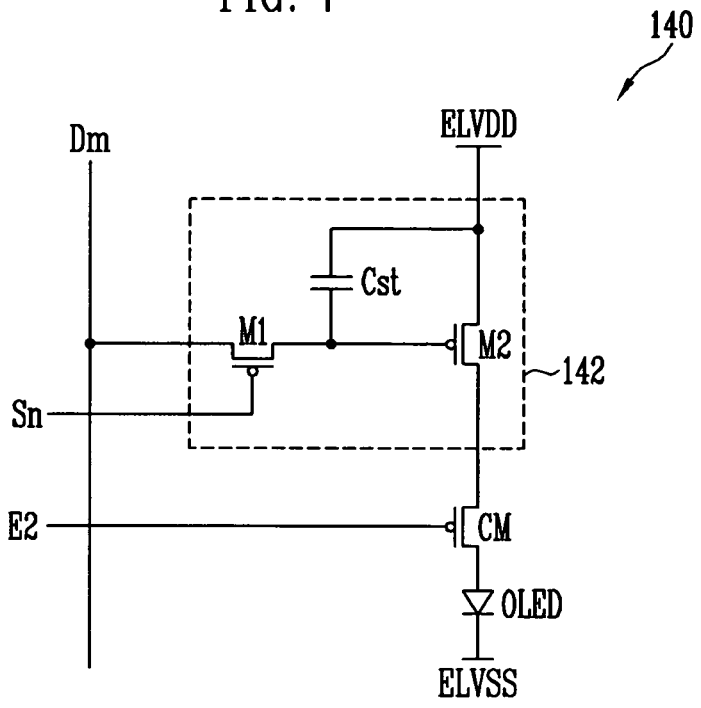
FIG. 7 is a diagram illustrating an embodiment of the pixel shown in FIG. 1.

FIG. 7 is a diagram illustrating a pixel according to an embodiment.

Referring to FIG. 7, a pixel 140, according to an embodiment, includes: an organic light emitting diode (OLED), a pixel circuit 142 controlling the amount of current supplied to the organic light emitting diode (OLED); and a control transistor CM connected between the pixel circuit 142 and the organic light emitting diode (OLED).

The anode electrode of the organic light emitting diode (OLED) is connected to the control transistor CM. The cathode electrode is connected to a second power supply ELVSS. The organic light emitting diode (OLED) produces light with predetermined luminance, in response to the amount of current supplied from the pixel circuit 142.

The pixel circuit 142 controls the amount of current supplied to the organic light emitting diode (OLED). The pixel circuit 142 may be various circuits, well known in the conventional art. For example, the pixel circuit 142 may include a first transistor M1, a second transistor M2, and a storage capacitor Cst.

A first electrode of the first transistor M1 is connected to the data line DM. A second electrode is connected to the gate electrode of the second transistor M2. A gate electrode of the first transistor M1 is connected to the scan line Sn. When a scan signal is supplied to the scan line Sn, the first transistor M1 is turned on and electrically connects the data line Dm with the gate electrode of the second transistor M2.

A first electrode of the second transistor M2 is connected to the first power supply ELVDD. A second electrode is connected to the first electrode of the control transistor CM. The gate electrode of the second transistor M2 is connected to the second electrode of the first transistor M1. The second transistor M2 supplies current, corresponding to voltage applied to the gate electrode thereof, to the organic light emitting diode (OLED).

The storage capacitor Cst is connected between the gate electrode of the second transistor M2 and the first power supply ELVDD. The storage capacitor Cst is charged with voltage corresponding to the data signal.

The first electrode of the control transistor CM is connected to the pixel circuit 142. The second electrode is connected to the anode electrode of the organic light emitting diode (OLED). The gate electrode of the control transistor CM is connected to the emission control line En. When an emission control signal is supplied to the emission control line En, the control transistor is turned on. When an emission control signal is not supplied, the control transistor is turned off.

Figure 8:
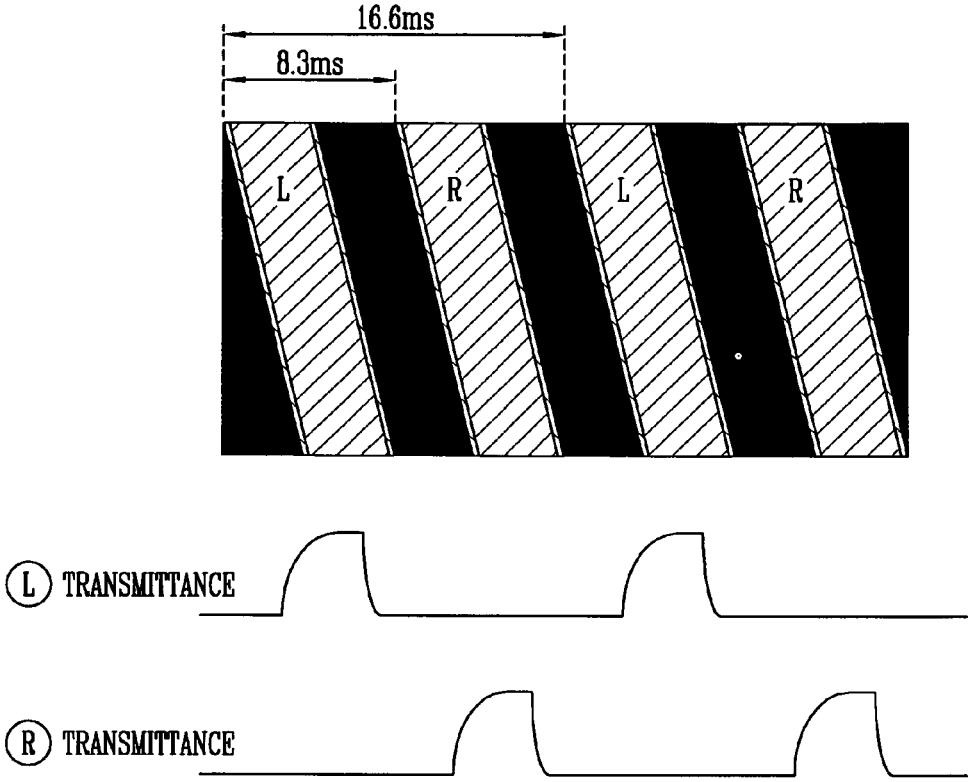
FIG. 8 is a diagram showing frame periods of an organic light emitting display device in the conventional art.

As shown in FIG. 8, the organic light emitting display device of the conventional art includes four frames. The four frames compose a period of 16.6 ms to implement a 3D image. In the four frames, the first frame displays a left image L and the third frame displays a right image R. The second frame and the fourth frame display a black image.

Shutter glasses receive light through the left lens for the first frame period and through the right lens for the third frame period. A user recognizes the 3D image supplied through the shutter glasses. The black image, which is displayed for the second frame and the fourth frame periods, prevents cross talk. Cross talk occurs because of an overlap of the left and right images.

However, in the conventional art, four frames are included in the period of 16.6 ms. Thus, the operation is performed at a 240 Hz driving frequency. When the organic light emitting display device operates at a high frequency, power consumption is increased, stability is decreased, and the manufacturing cost is increased.

Therefore, present embodiments may provide an organic light emitting display device that can operate at a low driving frequency. Present embodiments may also provide a driving method of the organic light emitting display device.

In present embodiments, according to an organic light emitting display device and a driving method of the organic light emitting display device, it may be possible to implement a 3D image, while supplying scan signals and data signals. The 3D image may be in synchronization with scan signals at a low driving frequency (e.g., 120 Hz).

Exemplary embodiments of the inventive concept have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the inventive concept as set forth in the following claims.

What is claimed is:

1. An organic light emitting display device, comprising:

a plurality of pixels positioned at intersections of scan lines, data lines, and emission control lines;

a pixel unit, including the plurality of pixels, and divided into two or more blocks;

a scan driver sequentially supplying scan signals to the scan lines;

a data driver supplying data signals to the data lines in synchronization with the scan signals; and two or more emission drivers respectively connected to the two or more blocks through emission control lines, wherein each emission driver supplies emission control signals, which enable corresponding pixels to emit light, to emission control lines connected thereto, and one or more emission control signals are supplied in each block simultaneously, such that at least one emission control signal supplied by one of the two or more emission drivers has a same starting time with at least one emission control signal supplied by another of the two or more emission drivers, wherein the two or more emission drivers include first and second emission drivers, and wherein emission control signals by the second emission driver are supplied in opposite sequential order of emission control signals by the first emission driver.

2. The organic light emitting display device as claimed in claim 1, wherein:

an emission driver, connected with emission control lines in a last block of the blocks, sequentially supplies emission control signals from a first emission control line to a last emission control line, after a scan signal is supplied to a first scan line in the last block.

3. The organic light emitting display device as claimed in claim 2, wherein:

emission drivers connected with emission control lines, respectively, in blocks other than the last block, sequentially supply emission control signals from a first emission control line to a last emission control line, connected thereto.

4. The organic light emitting display device as claimed in claim 3, wherein:

each emission driver supplies emission control signals to the first emission control lines simultaneously.

5. The organic light emitting display device as claimed in claim 3, wherein:

an emission driver, connected with emission control lines in a first block of the blocks, supplies emission control signals to a first emission control line, until a scan signal is supplied to a first scan line in the first block.

6. The organic light emitting display device as claimed in claim 5, wherein:

widths of all of the emission control signals, supplied to the emission control lines, are set to be the same.

7. The organic light emitting display device as claimed in claim 2, wherein:

the pixel unit is divided into three blocks, and the last block is a third block.

8. The organic light emitting display device as claimed in claim 7, wherein:

an emission driver, connected with emission control lines in a first block of the three blocks, sequentially supplies emission control signals from a first emission control line to a last emission control line, connected thereto.

9. The organic light emitting display device as claimed in claim 8, wherein:

emission control signals are simultaneously supplied to the first emission control lines in the first block and the third block.

10. The organic light emitting display device as claimed in claim 7, wherein:

an emission driver, connected with emission control lines in a second block of the three blocks, sequentially supplies emission control signals from a last emission control line to a first emission control line, connected thereto.

11. The organic light emitting display device as claimed in claim 10, wherein:

the emission driver, connected with the emission control lines in the second block, supplies an emission control signal to the last emission control line connected thereto, after a scan signal is supplied to a last scan line in the second block.

12. The organic light emitting display device as claimed in claim 7, wherein:

a number of emission control lines in the second block, between the first and third blocks, is set to be larger than a number of emission control lines in the first block and the third block.

13. The organic light emitting display device as claimed in claim 12, wherein:

the emission driver, connected with the emission control lines in the second block, simultaneously supplies emission control signals to the emission control lines connected thereto.

14. The organic light emitting display device as claimed in claim 12, wherein:

emission control signals are supplied to the emission control lines in the second block, simultaneously with an emission control signal being supplied to the first emission control line in the third block.

15. The organic light emitting display device as claimed in claim 12, wherein:

the emission driver, connected with the emission control lines in the first block, sequentially supplies emission control signals from the first emission control line to the last emission control line which are connected thereto.

16. The organic light emitting display device as claimed in claim 15, wherein:

an emission control signal is supplied to the last emission control line in the first block, simultaneously with a supply of the emission control signals to the emission control line in the second block.

17. The organic light emitting display device as claimed in claim 1, wherein each pixel of the plurality of pixels includes:

an organic light emitting diode;

a pixel circuit charged with a voltage corresponding to a data signal when a scan signal is supplied to a scan line; the pixel circuit controlling the amount of current supplied to the organic light emitting diode, corresponding to the voltage; and a control transistor connected between the organic light emitting diode and the pixel circuit, the control transistor turned on when an emission control signal is supplied to an emission control line, the control transistor turned off in other cases.

18. The organic light emitting display device as claimed in claim 1, wherein a non-emission state is provided to each of the two or more blocks for a first period, the plurality of pixels are in the non-emission state during the first period, and the first period corresponds to a time between frames.

19. A display, comprising:

a plurality of pixels positioned at intersections of scan lines, data lines, and emission control lines, the plurality of pixels being divided into blocks including a first block, a second block, and a third block; and emission drivers including a first emission driver, a second emission driver, and a third emission driver respectively connected to the first block, the second block, and the third block through the emission control lines, wherein:

emission control signals, which enable corresponding pixels to emit light, by the first and third emission drivers are sequentially supplied, and emission control signals by the second emission driver are supplied in opposite sequential order of the emission control signals by the first and third emission drivers.

* * * * *